US010232419B2

(12) United States Patent
Imanari et al.

(10) Patent No.: US 10,232,419 B2
(45) Date of Patent: Mar. 19, 2019

(54) MOTOR SPEED CONTROL DEVICE FOR ROLLING MILL

(71) Applicant: TOSHIBA MITSUBISHI-ELECTRIC INDUSTRIAL SYSTEMS CORPORATION, Chuo-ku (JP)

(72) Inventors: Hiroyuki Imanari, Tokyo (JP); Mitsuhiko Sano, Tokyo (JP)

(73) Assignee: TOSHIBA MITSUBISHI-ELECTRIC INDUSTRIAL SYSTEMS CORPORATION, Chuo-ku (JP)

( * ) Notice: Subject to any disclaimer, the term of this patent is extended or adjusted under 35 U.S.C. 154(b) by 246 days.

(21) Appl. No.: 15/114,730

(22) PCT Filed: Feb. 14, 2014

(86) PCT No.: PCT/JP2014/053478

§ 371 (c)(1),
(2) Date: Jul. 27, 2016

(87) PCT Pub. No.: WO2015/121974

PCT Pub. Date: Aug. 20, 2015

(65) Prior Publication Data

US 2016/0339492 A1 Nov. 24, 2016

(51) Int. Cl.

| | |
|---|---|
| ***B21B 37/46*** | (2006.01) |
| ***B21B 35/00*** | (2006.01) |
| ***B21B 38/00*** | (2006.01) |

(52) U.S. Cl.

CPC ..... *B21B 37/46* (2013.01); *B21B 35/00* (2013.01); *B21B 38/00* (2013.01); *B21B 2275/04* (2013.01)

(58) Field of Classification Search

CPC ..... B21B 2275/04; B21B 2275/10; B21B 2275/12; B21B 37/46

See application file for complete search history.

(56) References Cited

U.S. PATENT DOCUMENTS 4,727,927 A * 3/1988 Popik ..... B22D 11/20 164/154.7
2007/0043533 A1* 2/2007 Wiles ..... G01M 13/025 702/183

FOREIGN PATENT DOCUMENTS

CA 2703890 A1 * 5/2009 ..... B21B 37/46
DE 102006017727 A1 * 10/2007 ..... G01B 7/003

(Continued)

OTHER PUBLICATIONS

Machine Translation of JP2003-145209, 5 Pages.*
Machine Translation of DE102006017727, 8 Pages.*
Combined Chinese Office Action and Search Report dated Mar. 23, 2017 in Patent Application No. 201480075472.1 (with partial English language translation and English translation of categories of cited documents).

(Continued)

*Primary Examiner* — Teresa M Ekiert
*Assistant Examiner* — Gregory Swiatocha
(74) *Attorney, Agent, or Firm* — Oblon, McClelland, Maier & Neustadt, L.L.P.

(57) ABSTRACT

A motor speed control device for a rolling mill, which includes a rolling roll that rolls a metal material, a roll rotation shaft directly connected to the rolling roll, a motor rotation shaft that transmits power to the roll rotation shaft, and a motor that drives the motor rotation shaft, includes: a non-contact type speed sensor arranged at a position close to the rolling roll with spacing to a circumferential surface of the roll rotation shaft to detect a roll rotation shaft angular speed of the roll rotation shaft; and a speed controller that controls a speed of the motor based on a comparison value between an actual value and a target angular speed of the rolling roll so that the actual value coincides with the target angular speed. The actual value is the roll rotation shaft angular speed to be fed back to the speed controller.

5 Claims, 5 Drawing Sheets

(56) References Cited

FOREIGN PATENT DOCUMENTS

| | | | | | |
|---|---|---|---|---|---|
| JP | 4-182030 | A | | 6/1992 | |
| JP | 5-7910 | A | | 1/1993 | |
| JP | 6-122007 | A | | 5/1994 | |
| JP | 6-190417 | A | | 7/1994 | |
| JP | 6-277724 | A | | 10/1994 | |
| JP | 7-75362 | A | | 3/1995 | |
| JP | 7-214131 | A | | 8/1995 | |
| JP | 8-206718 | A | | 8/1996 | |
| JP | 10-71409 | A | | 3/1998 | |
| JP | 2003145209 | A | * | 5/2003 | ..... B21B 27/10 |
| JP | 2009-505277 | A | | 2/2009 | |
| JP | 2011-115825 | A | | 6/2011 | |
| WO | WO 00/78476 | A1 | | 12/2000 | |
| WO | WO 0078476 | A1 | * | 12/2000 | ..... B21B 37/007 |

OTHER PUBLICATIONS

Office Action dated Jan. 11, 2017 in Korean Patent Application No. 10-2016-7025040 (with Partial English Translation).

International Search Report dated Apr. 15, 2014 in PCT/JP14/053478 Filed Feb. 14, 2014.

Combined Office Action and Search Report dated Nov. 1, 2017 in Chinese Patent Application No. 201480075472.1 with unedited computer generated English translation of the Office Action and English translation of categories of cited documents, cited document AX therein, 16 pages.

Yang Guang, et al, "The Use of Hall Sensor in Measuring the Velocity of Roller", Machine Building and Automation, 35(4): Aug. 2006, pp. 63-65 with English Abstract.

* cited by examiner

MOTOR SPEED CONTROL DEVICE FOR ROLLING MILL

FIELD

The present invention relates to a motor speed control device for a rolling mill including a rolling roll for rolling a metal material and a motor for driving the rolling roll, and in particular, relates to a motor speed control device that directly detects the speed of the rolling roll and thereby controls the speed of the motor.

BACKGROUND

Rolling includes rolling of a steel material and rolling of nonferrous metal material, such as aluminum or copper. Moreover, there is a difference in shape, such as rolling of a plate material or rolling of a bar material. Moreover, examples include hot rolling or plate rolling that rolls a material by heating thereof to high temperature and cold rolling that rolls a material of room temperature. Materials are separately formed in accordance with particular uses or purposes.

In any type of rolling, a material is put between rolling rolls to cause it to be thin or long and narrow. Therefore, as a power source for driving the rolling rolls, a motor is commonly used.

A general configuration of a rolling mill will be described. The rolling mill includes a pair of parallel rolling rolls for rolling a material. Each of the rolling rolls includes a spindle, which is a rotation shaft. Moreover, the rolling mill includes a motor. The motor includes a motor rotation shaft. The spindle and the motor rotation shaft are connected via a gear mechanism, and thereby power of the motor is transmitted to the spindle. Moreover, to the motor rotation shaft, a motor speed sensor for detecting the speed thereof is attached.

In such a configuration, the speed of the motor is controlled based on a comparison value between an actual value of the speed detected by the motor speed sensor and a target value of the motor speed so that the actual value and the target value coincide with each other.

Note that the applicant recognizes the following literatures as being related to the present invention.

CITATION LIST

Patent Literature

[PTL 1] JP 8-206718A
[PTL 2] JP 2011-115825A
[PTL 3] JP 10-71409A

SUMMARY

Technical Problem

However, it is the speed of the rolling roll that greatly affects the rolled products. Accordingly, the speed of the rolling roll, not the speed of the motor, is really desired to be controlled.

However, conventionally, a method for directly detecting the speed of the rolling roll has not been used. Reasons thereof are as follows.

(A) On the rolling roll side, it is a common practice to pour roll cooling water for preventing the roll from being damaged by heat transmitted from a high-temperature material to the roll. Consequently, a roll speed sensor cannot be directly attached to the rolling roll. Even if being attached, the sensor is apt to be out of order.

(B) When wearing out, the rolling roll is detached for polishing and replaced with a different roll. Consequently, the roll speed sensor is detached and attached in each case.

(C) In a hot sheet rolling mill or a plate rolling mill, a large impact is made on the rolling roll when a sheet or a plate, hereinafter a plate, is passed through the rolls. Consequently, even though the roll speed sensor is directly attached to the roll, the roll speed sensor is apt to be out of order due to the impact.

PTL 1 describes a device and method for suppressing twist vibration occurring on a shaft connecting a rolling roll and a motor. The speed detected by a motor speed sensor is primarily used for speed control, and the speed detected by a roll speed sensor is of lower priority. Moreover, the roll speed sensor is directly mounted to the rolling roll.

PTL 2 describes a device and method for suppressing twist vibration occurring on a shaft connecting a rolling roll and a motor. Since the speed of the rolling roll cannot be directly detected, a method of estimating thereof from the speed of the motor is employed.

PTL 3 describes a method for directly detecting the speed of a rolling roll. PTL 3 intends to protect a rolling mill, and does not intend to improve accuracy of speed control based on a speed detected value. Moreover, the roll speed sensor is directly mounted to the rolling roll.

The present invention has been made to solve the above-described problems, and has as an object to provide a motor speed control device for a rolling mill capable of improving accuracy of speed control by directly controlling the speed of the rolling roll.

Solution to Problem

A first aspect of the present invention, is a motor speed control device for a rolling mill including a rolling roll configured to roll a metal material, a roll rotation shaft directly connected to the rolling roll, a motor rotation shaft configured to transmit power to the roll rotation shaft, and a motor configured to drive the motor rotation shaft, the motor speed control device for a rolling mill comprising:

- a non-contact type speed sensor configured to be arranged at a position close to the rolling roll with spacing to a circumferential surface of the roll rotation shaft and to detect a roll rotation shaft angular speed, which is an angular speed of the roll rotation shaft; and
- a speed controller configured to control speed of the motor based on a comparison value between an actual value and a target angular speed value of the rolling roll so that the actual value coincides with the target angular speed,
- wherein the actual value is the roll rotation shaft angular speed to be fed back to the speed controller.

A second aspect of the present invention is the motor speed control device for a rolling mill according to the first aspect, wherein

- the non-contact type speed sensor is arranged on a perpendicular line that crosses a shaft center of the roll rotation shaft and is perpendicular to a surface to be rolled of the metal material, and
- the roll rotation shaft is movable on the perpendicular line independent of the non-contact type speed sensor.

A third aspect of the present invention is the motor speed control device for a rolling mill according to the first or the second aspects, further comprising a waterproofing and dust-proofing wall between the non-contact type speed sensor and the rolling roll.

A fourth aspect of the present invention is the motor speed control device for a rolling mill according to any one of the first to the third aspects, further comprising:

a motor speed sensor to detect a motor rotation shaft angular speed, which is an angular speed of the motor rotation shaft; and a switch capable of switching the actual value to any of the roll rotation shaft angular speed and the motor rotation shaft angular speed.

A fifth aspect of the present invention is the motor speed control device for a rolling mill according to any one of the first to the third aspects, further comprising:

a motor speed sensor to detect a motor rotation shaft angular speed, which is an angular speed of the motor rotation shaft, wherein the actual value is a synthetic value synthesizing a value obtained by multiplying the motor rotation shaft angular speed by a ratio $\alpha$ ($0 \leq \alpha \leq 1$) and a value obtained by multiplying the roll rotation shaft angular speed by a ratio $(1-\alpha)$, and the ratio $\alpha$ is set larger than the ratio $(1-\alpha)$ when the metal material is threading, and is set smaller than the ratio $(1-\alpha)$ as time proceeds.

Advantageous Effects of Invention

According to the first aspect, the non-contact speed sensor for detecting the roll rotation shaft angular speed is arranged at a position close to the rolling roll with spacing to a circumferential surface of the roll rotation shaft. Because of a non-contact type, there are effects, such as, not being affected when the rolling roll is replaced, not being affected by a large impact on the rolling roll when a plate is passed, and so forth.

Moreover, according to the first aspect, the roll rotation shaft angular speed at the position close to the rolling roll is detected by the non-contact type speed sensor. This actual value is assumed to be the rolling roll speed and fed back to the speed controller, to thereby control the speed of the motor so that the actual value coincides with the target angular speed of the rolling roll. According to the first aspect, it is possible to directly control the rolling roll speed, and to improve accuracy of speed control.

According to the second aspect, the non-contact type speed sensor can avoid an effect due to a large impact applied to the rolling roll when the plate is passed. Moreover, in the rolling roll, positions in the vertical direction are significantly displaced by the thickness of a material-to-be-rolled, and thereby, there is a possibility that detection performance of the speed sensor is deteriorated depending on the position thereof. However, according to the sensor position in the second aspect, deterioration of detection performance due to misalignment in the vertical direction can be suppressed.

According to the third aspect, since a waterproofing and dust-proofing wall is provided between the non-contact type speed sensor and the rolling roll, it is possible to protect the non-contact type speed sensor from the roll cooling water poured to the rolling roll or the dust generated by the iron oxide film formed on the surface of the material-to-be-rolled 12 that is crushed and flies off when rolling is performed.

According to the fourth aspect, since a selector switch enables switching between the output of the non-contact type speed sensor and the output of the motor speed sensor, the speed sensor and the control system can be provided with redundancy.

According to the fifth aspect, it is possible to facilitate stability in the control system by assigning weights to the output of the non-contact type speed sensor and the output of the motor speed sensor and dynamically changing the weights.

DESCRIPTION OF EMBODIMENTS

Hereinafter, embodiments according to the present invention will be described in detail with reference to attached drawings. Note that components common to respective figures are assigned with the same sign and duplicate descriptions will be omitted.

Embodiment 1

System Configuration of Embodiment 1

Figure 1:
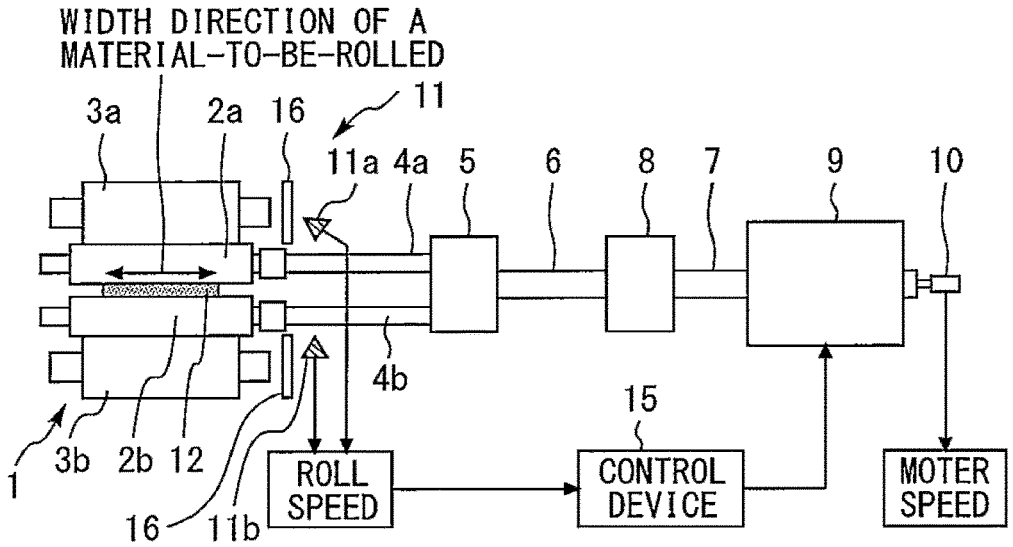
FIG. 1 is a diagram for illustrating a system configuration related to Embodiment 1 according to the present invention.

FIG. 1 is a diagram for illustrating a system configuration related to Embodiment 1 according to the present invention. FIG. 1 shows a configuration common in a finishing rolling mill of a hot sheet mill or a cold rolling mill. The system shown in FIG. 1 includes a rolling mill 1. The rolling mill 1 includes an upper work roll 2*a* and a lower work roll 2*b* that constitute a rolling roll. The upper work roll 2*a* and the lower work roll 2*b* are arranged in parallel. The material-to-be-rolled 12 is, for example, a metal material and is rolled by the upper work roll 2*a* and the lower work roll 2*b*.

Over the upper work roll 2*a*, an upper backup roll 3*a* for suppressing bending of the work roll in the width direction is provided. Under the lower work roll 2*b*, a lower backup roll 3*b* for suppressing bending of the work roll in the width direction is provided.

FIG. 1 shows the rolling roll having a so-called 4Hi-configuration, namely, a 4-roll configuration of the upper work roll 2*a*, lower work roll 2*b*, upper backup roll 3*a* and lower backup roll 3*b*. However, the present invention is not limited to the 4Hi-configuration; the present invention is applicable to a 2Hi-configuration having only the upper work roll 2*a* and the lower work roll 2*b* or a 6Hi-configuration in which an intermediate roll is interposed between the work roll and the backup roll.

The upper work roll 2*a* is directly attached to a spindle 4*a*, which is the roll rotation shaft. The lower work roll 2*b* is directly attached to a spindle 4*b*, which is the roll rotation shaft.

Moreover, the rolling mill 1 includes a motor 9 that drives a motor rotation shaft 7. To the motor rotation shaft 7, a motor speed sensor 10 for detecting an angular speed thereof is attached.

Each of the spindles 4*a* and 4*b* is connected to the motor rotation shaft 7 via a gear mechanism. The power of the motor 9 is transmitted to the spindles 4*a* and 4*b*. In the example shown in FIG. 1, each of the spindles 4*a* and 4*b* is connected to a shaft 6 via a pinion gear 5. The shaft 6 is connected to the motor rotation shaft 7 via a reduction gear 8. The spindles 4*a*, 4*b* and the motor rotation shaft 7 are connected via the gear mechanism (the pinion gear 5, the shaft 6, and the reduction gear 8), and thereby the power of the motor 9 is transmitted to the spindles 4*a* and 4*b*.

A characteristic configuration of the system shown in FIG. 1 will be described. A non-contact type speed sensor 11*a* is arranged at a position close to the upper work roll 2*a* with spacing to a circumferential surface of the spindle 4*a*, and detects a roll rotation shaft angular speed, which is an angular speed of the spindle 4*a*. In a similar manner, a non-contact type speed sensor 11*b* is arranged at a position close to the lower work roll 2*b* with spacing to a circumferential surface of the spindle 4*b*, and detects a roll rotation shaft angular speed, which is an angular speed of the spindle 4*b*.

The system of the embodiment includes a control device 15 having a processor, a memory and input and output interfaces. To the input interface of the control device 15, the non-contact type speed sensors 11*a* and 11*b* are connected. To the output interface of the control device 15, the motor 9 is connected. The control device 15 controls the speed of the motor 9 based on target angular speeds of the spindles 4*a* and 4*b* scheduled in accordance with a rolled product in advance and outputs of the non-contact type speed sensors 11*a* and 11*b*.

Figure 3:
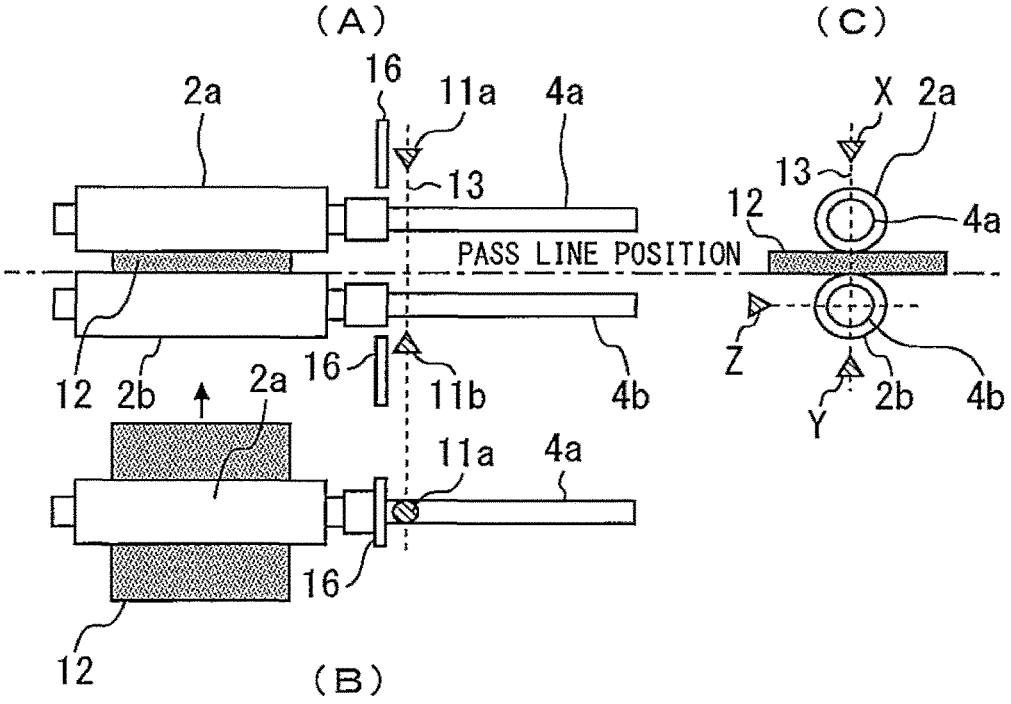
FIG. 3 is a diagram for illustrating attachment positions of the non-contact type speed sensors 11*a* and 11*b* in Embodiment 1 according to the present invention.

FIG. 3 is a diagram for illustrating attachment positions of the non-contact type speed sensors 11*a* and 11*b* in Embodiment 1 according to the present invention. FIG. 3A is a front view in which the rolling mill 1 is viewed from a conveyance direction of the material-to-be-rolled 12. FIG. 3C is a side view of the rolling mill 1. FIG. 3B is atop view of the rolling mill 1.

As shown in FIG. 3, the non-contact type speed sensor 11*a* is arranged on a perpendicular line 13 that crosses a shaft center of the spindle 4*a* and is perpendicular to a surface to be rolled of the material-to-be-rolled 12. The spindle 4*a* is movable on the perpendicular line 13 independent from the non-contact type speed sensor 11*a*.

In the example shown in FIG. 3, the non-contact type speed sensor 11*a* is arranged at a position X with the spindle 4*a* in view from above the spindle 4*a*. Moreover, the non-contact type speed sensor 11*b* is arranged at a position Y with the spindle 4*b* in view from beneath the spindle 4*b*, or a position Z with the spindle 4*b* in view from the side of the spindle 4*b*.

As shown in FIG. 3, an upper surface of the lower work roll 2*b* is generally set at a constant height for making a pass line constant. Since the work roll is worn out, maintenance by polishing is provided, and thereby a diameter thereof is gradually reduced. Accordingly, the diameter of the work roll varies from a brand-new maximum diameter to a using limit minimum diameter. As described above, in the case where the upper surface of the lower work roll 2*b* is set to a constant height, the position of the spindle 4*b* connected to the lower work roll 2*b* merely moves vertically to an extent of difference between the brand-new maximum work roll diameter and the using limit minimum work roll diameter. Therefore, even if the non-contact type speed sensor 11*b* is placed away from the spindle 4*b*, the spindle 4*b* does not significantly go off the view of the non-contact type speed sensor 11*b*.

On the other hand, the position of the upper work roll 2*a* in the vertical direction is significantly displaced by the thickness of the material-to-be-rolled 12. Therefore, the position of the spindle 4*a* connected to the upper work roll 2*a* is significantly displaced in some cases. Consequently, the non-contact type speed sensor 11*a* is placed above the spindle 4*a* to reduce the effects caused by displacement in the vertical direction.

Moreover, the iron oxide film formed on the surface of the material-to-be-rolled 12 is crushed and flies off when rolling is performed, and thereby a great amount of dust is generated. Moreover, the roll cooling water is poured onto the work rolls 2*a* and 2*b*. If the dust or cooling water adheres to the non-contact type speed sensor 11*a* or 11*b*, the sensor is adversely affected.

Then, in the system of Embodiment 1 according to the present invention, walls 16 are arranged between the non-contact type speed sensor 11*a* and the upper work roll 2*a* and between the non-contact type speed sensor 11*b* and the lower work roll 2*b*. The wall 16 is a waterproofing and dust-proofing wall. With the wall 16, it is possible to prevent the roll cooling water or dust from adhering to the sensors, and to arrange the non-contact type speed sensors 11*a* and 11*b* at positions closer to the work rolls 2*a* and 2*b*. By detecting the angular speed of the spindles 4*a* and 4*b* (the roll rotation shaft angular speed) at the positions closer to the work rolls 2*a* and 2*b*, the roll rotation shaft angular speed can be regarded as the speed of the work rolls 2*a* and 2*b* with higher accuracy.

Figure 2:
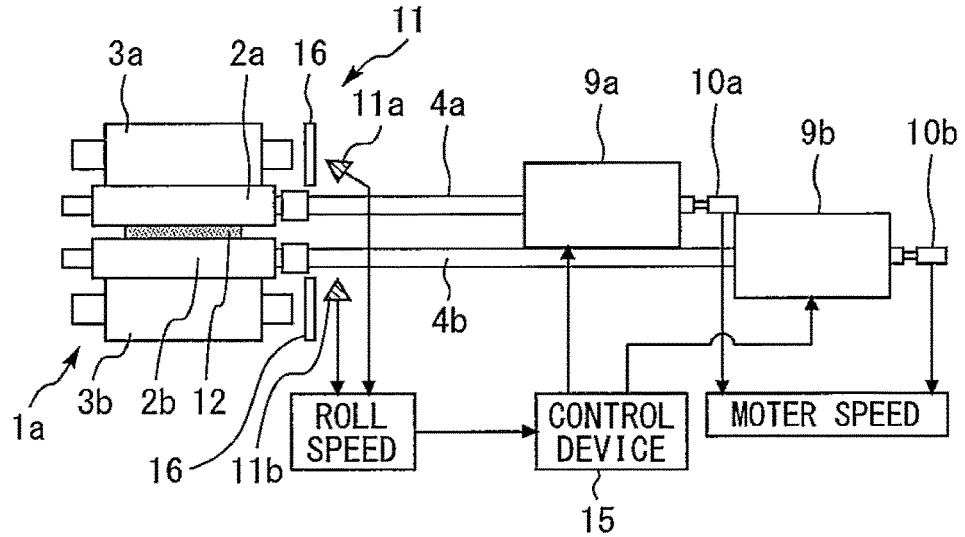
FIG. 2 is a diagram for illustrating another system configuration related to Embodiment 1 according to the present invention.

By the way, in the above-described system of Embodiment 1, the rolling mill 1 is a rolling mill of a type that drives the upper work roll 2*a* and the lower work roll 2*b* by the common motor 9. However, the present invention can be applied in a rolling mill 1*a* shown in FIG. 2. The rolling mill 1*a* is a rolling mill of a type that drives the upper work roll 2*a* and the lower work roll 2*b* by a single motor 9*a* and a single motor 9*b*, respectively. This is a configuration common in a roughing mill of a hot sheet mill or a plate mill. In FIG. 2, also, since the arrangement of the non-contact type speed sensor 11*a* and 11*b* is similar to that of FIG. 1 and FIG. 3, description thereof will be omitted.

In the following description, in a case where the non-contact type speed sensors 11*a* and 11*b* are not particularly distinguished, the sensors are simply referred to as a non-contact type speed sensor 11.

[Characteristic Control in Embodiment 1]

Figure 4:
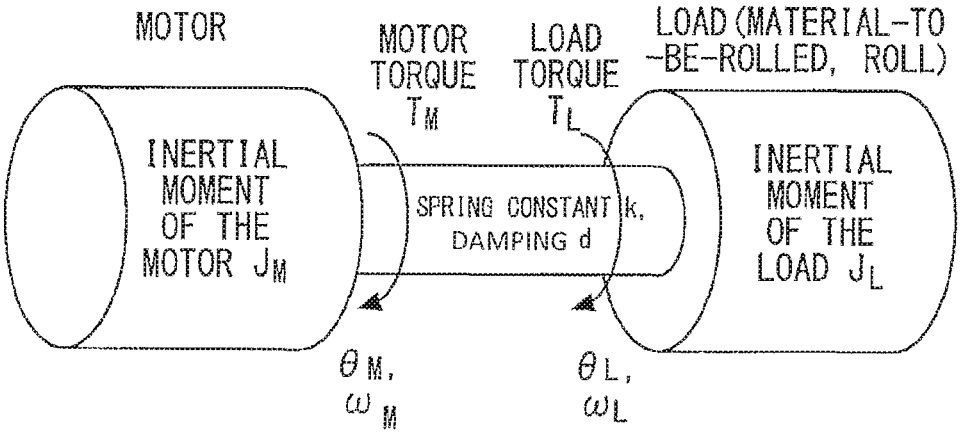
FIG. 4 is a diagram showing two inertial frames, the motor and load.

FIG. 4 is a diagram showing two inertial frames, the motor and load (including the material-to-be-rolled, the work roll and the backup roll).

The shaft connecting the motor and the load is generally made of metal, which is not a rigid body, and therefore, the motor and the load can be considered as a two-mass system. Since the shaft has a mass, of course, the system may be considered as a multiple-mass system that has two or more masses; however, the system is considered as the two-mass system here.

Figure 5:
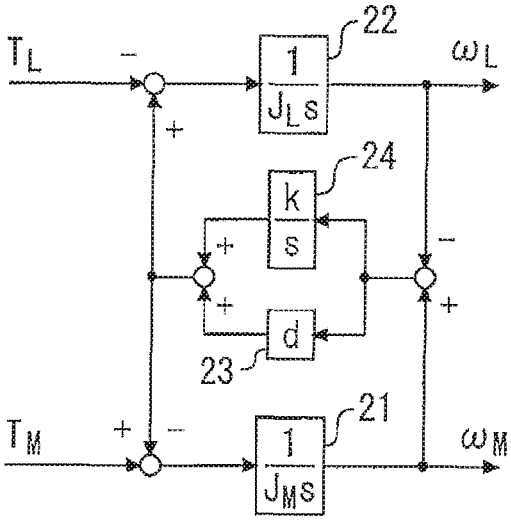
FIG. 5 is a block diagram showing the 2-mass system shown in FIG. 4 in a control block.

FIG. 5 is a block diagram showing the 2-mass system shown in FIG. 4 in a control block. In FIG. 5, a block 21 represents inertia of the motor and indicates that a sum of a torque component from blocks 23 and 24 and a motor torque $T_M$ is subjected to time integration by an inertial moment of the motor $J_M$ to be converted into a motor angular speed $\omega_M$. A block 22 represents an inertia of the load side (the rolling roll side) and indicates that a sum of a torque component from blocks 23 and 24 and a load torque $T_L$ is subjected to time integration by an inertial moment of the load $J_L$ to be converted into a load (rolling roll) angular speed $\omega_L$. A block 23 indicates that a difference between the motor angular speed $\omega_M$ and the load angular speed $\omega_L$ is converted into a torque by dumping d (an effect of attenuating vibration) of the shaft. A block 24 indicates that the difference between the motor angular speed $\omega_M$ and the load angular speed $\omega_L$ is subjected to time integration and converted into a torque by a spring constant k of the shaft.

Figure 9:
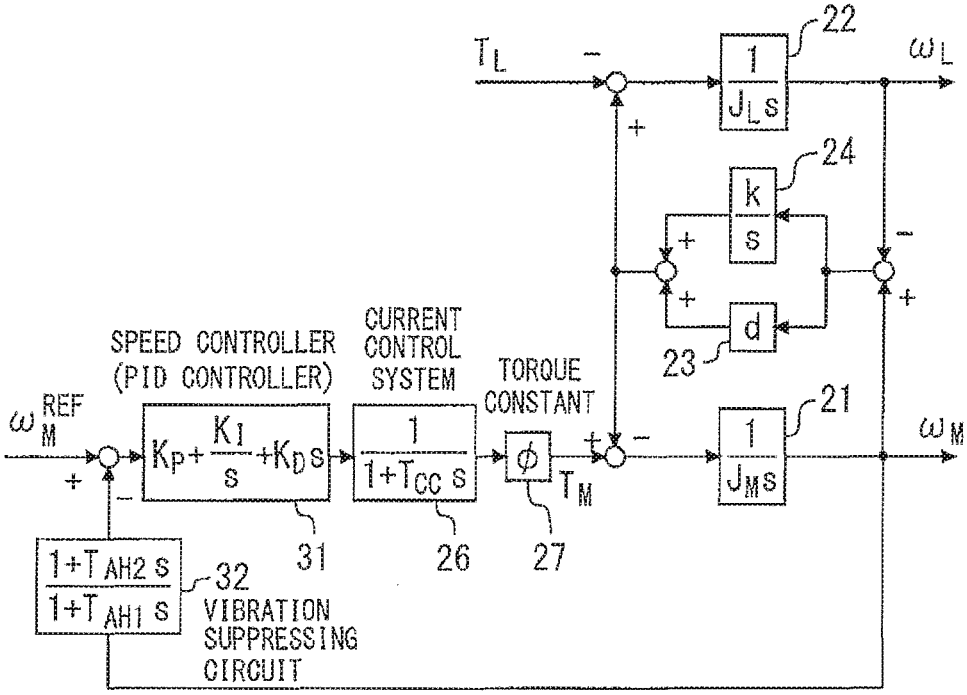
FIG. 9 RELATED ART
FIG. 9 is a control block diagram showing a control block implemented in the control device as a comparison target.

Prior to describing the characteristic control in the system of the embodiment, a control device, which is a comparison target, will be described. FIG. 9 is a control block diagram showing a control block implemented in the control device as a comparison target.

Based on the 2-mass system of FIG. 5, in the control device of the comparison target, speed control is performed, as shown in FIG. 9, by feeding back the motor angular speed $\omega_M$ of the motor 9 (an angular speed of the motor rotation shaft 7 (a motor rotation shaft angular speed) detected by the motor speed sensor 10 is regarded as the motor angular speed $\omega_M$), and the load angular speed $\omega_L$ is not fed back.

In FIG. 9, the speed controller 31 performs a PID operation with respect to a deviation of a reference value indicating a target angular speed $\omega_M^{REF}$ of the motor 9 provided from a higher level controller and the motor angular speed $\omega_M$, which is a feedback value, to thereby operate a current reference value. In a current control system 26, a current actual value is controlled to coincide with the current reference value; however, in FIG. 9, the current control system is simplified in illustration. In other words, the current control system is regarded to be represented by a first-order lag system having a time constant $T_{CC}$. A block 27 is a torque constant for converting a current into a torque, which simulates, not processing within the controller, but conversion in the motor 9. The motor angular speed $\omega_M$, which is a feedback value, is regarded as a value obtained by running a detection value of the motor speed sensor 10 through a vibration suppressing circuit 32 for suppressing speed variations, in some cases. As the vibration suppressing circuit 32, a phase-lead or phase-lag circuit is used in general. However, since a derivative term $K_D$ of the speed controller 31 also has a vibration suppressing effect, there is also a case in which any of the derivative term $K_D$ and the vibration suppressing circuit 32 is used.

In this manner, in the control device of the comparison target, the vibration suppressing circuit 32 is inserted in the process of feeding back the motor angular speed $\omega_M$, or a control parameter is set in the speed controller 31 to control vibration. However, the control device of the comparison target is to suppress vibration in the angular speed consistently on the motor 9 side.

However, it is the load angular speed $\omega_L$ that greatly affects the rolled products. Accordingly, the load angular speed $\omega_L$, not the motor angular speed $\omega_M$, is really desired to be controlled.

Figure 6:
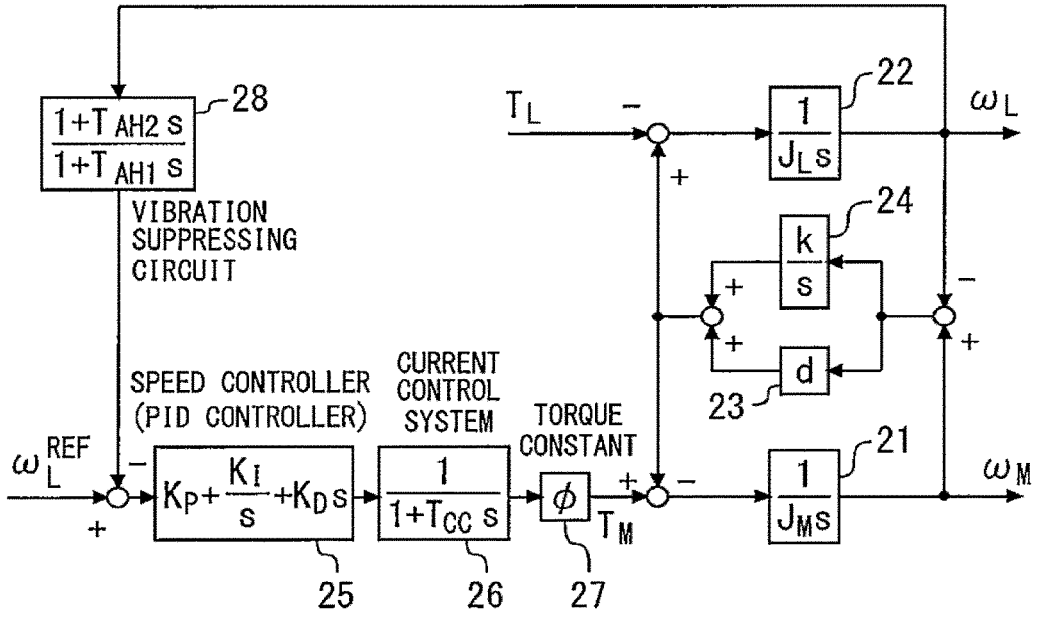
FIG. 6 is a control block diagram showing a control block implemented in the control device 15 in the system related to Embodiment 1 according to the present invention.

FIG. 6 is a control block diagram showing a control block implemented in the control device 15 in the system related to Embodiment 1 according to the present invention. In FIG. 6, an example performing speed control by feeding back the load angular speed $\omega_L$ is shown. In FIG. 6, the speed controller 25 may have the same configuration as the speed controller 31 in FIG. 9. However, the load angular speed $\omega_L$ sometimes becomes vibratory, and therefore, the parameter set in the speed controller 25 is different from that of the speed controller 31 in some cases.

Moreover, the load angular speed $\omega_L$, which is a feedback value, is regarded as a value obtained by running a detection value by the non-contact type speed sensor 11 through a vibration suppressing circuit 28 for suppressing speed variations, in some cases. The vibration suppressing circuit 28 may have the same configuration as the vibration suppressing circuit 32; however, the parameter is different in some cases. However, since a derivative term $K_D$ of the speed controller 25 also has a vibration suppressing effect, there is also a case in which any of the derivative term $K_D$ and the vibration suppressing circuit 28 is used.

According to the control block shown in FIG. 6, it is possible to directly control the speed of the rolling roll and improve accuracy of speed control by regarding the angular speed of the spindles 4*a* and 4*b* detected by the non-contact type speed sensors 11*a* and 11*b* (the roll rotation shaft angular speed) as the load angular speed $\omega_L$ and providing feedback thereof to the speed controller 25.

As described above, according to the system related to Embodiment 1 of the present invention, in the rolling mill that rolls metal materials, the speed of the rolling roll can be detected without being affected by environment by detecting the roll rotation shaft angular speed directly connected to the rolling roll by the non-contact type speed sensor. By controlling the speed of the motor by use of the speed, it becomes possible to directly control the roll speed. Moreover, an optimum parameter for speed control of the roll can be set, and accordingly, accuracy of speed control can be improved.

Embodiment 2

System Configuration of Embodiment 2

Next, Embodiment 2 according to the present invention will be described with reference to FIG. 7. The system of the embodiment can be realized by implementing a control block of FIG. 7 to be described later to the control device 15 in the configuration shown in FIG. 1 to FIG. 3.

In the system of Embodiment 1, the roll rotation shaft angular speed detected by the non-contact type speed sensor 11 is regarded as the load angular speed $\omega_L$, and only the load angular speed $\omega_L$ is fed back to the speed controller 25. However, there is a possibility that the non-contact type speed sensor 11 deviates from a sound state.

[Characteristic Control in Embodiment 2]

Therefore, in the system related to Embodiment 2 according to the present invention, in addition to the non-contact type speed sensor 11 detecting the roll rotation shaft angular speed, the motor speed sensor 10 for detecting the motor rotation shaft angular speed, which is the angular speed of the motor rotation shaft 7, is provided, and a switch capable of switching the actual value fed back to the speed controller 25 to any of the roll rotation shaft angular speed and the motor rotation shaft angular speed is provided.

Figure 7:
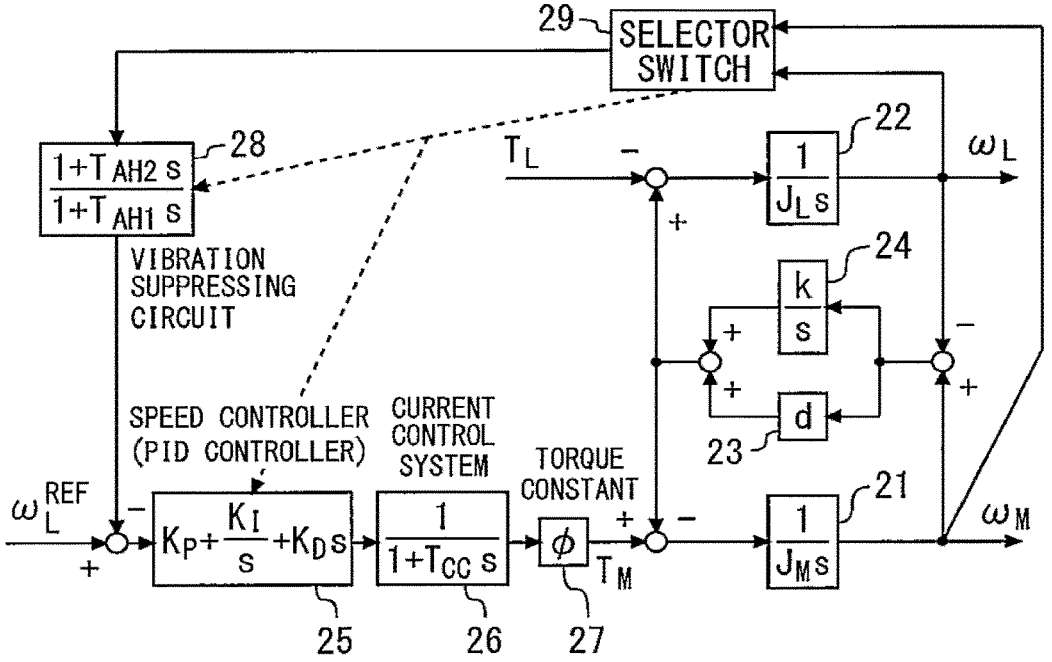
FIG. 7 is a control block diagram showing a control block implemented in the control device 15 in the system related to Embodiment 2 according to the present invention.

FIG. 7 is a control block diagram showing a control block implemented in the control device 15 in the system related to Embodiment 2 according to the present invention. Of the configurations shown in FIG. 7, configurations similar to those of FIG. 6 are provided with same signs, and description thereof will be omitted.

The control block shown in FIG. 7 includes a selector switch 29 capable of switching between the motor angular speed $\omega_M$ and the load angular speed $\omega_L$ to be used as an input to the speed controller 25. For example, status of the motor speed sensor 10 and the non-contact type speed sensor 11 is monitored at all times and the signal from the non-contact type speed sensor 11 is mainly used; however, when the sensor deviates from the sound state, switching to the signal from the motor speed sensor 10 is immediately carried out to be used. The reverse thereof is naturally possible.

At this time, there is a case in which it is necessary to switch the parameter in the speed controller 25 and the parameter in the vibration suppressing circuit 28 depending on whether the load angular speed $\omega_L$ is used or the motor angular speed $\omega_M$ is used. The broken lines extending from the selector switch 29 to the speed controller 25 and the vibration suppressing circuit 28 refer this case.

The speed switch can be switched to be used in this manner, and accordingly, the speed sensor and the control system can be provided with redundancy.

Embodiment 3

System Configuration of Embodiment 3

Next, Embodiment 3 according to the present invention will be described with reference to FIG. 8. The system of the embodiment can be realized by implementing a control block of FIG. 8 to be described later to the control device 15 in the configuration shown in FIG. 1 to FIG. 3.

In the system of Embodiment 1, the roll rotation shaft angular speed detected by the non-contact type speed sensor 11 is regarded as the load angular speed $\omega_L$, and only the load angular speed $\omega_L$ is fed back to the speed controller 25. However, in threading in the hot rolling mill, a large torque is applied to the rolling roll and thereby the load angular speed $\omega_L$ becomes vibratory, and if the load angular speed $\omega_L$ is inputted to the speed controller 25 as it is, the control becomes instable in some cases.

[Characteristic Control in Embodiment 3]

Therefore, in the system related to Embodiment 3 according to the present invention, the motor speed sensor 10 for detecting the angular speed of the motor rotation shaft 7 is provided, and the actual value to be fed back to the speed controller 25 is defined as a synthetic value synthesizing a value obtained by multiplying the motor rotation shaft angular speed by a ratio $\alpha$ ($0 \leq \alpha \leq 1$) and a value obtained by multiplying the roll rotation shaft angular speed by a ratio $(1-\alpha)$. Here, the ratio $\alpha$ is set larger than the ratio $(1-\alpha)$ when the material-to-be-rolled 12 is threading, and then set smaller than the ratio $(1-\alpha)$ as time proceeds.

Figure 8:
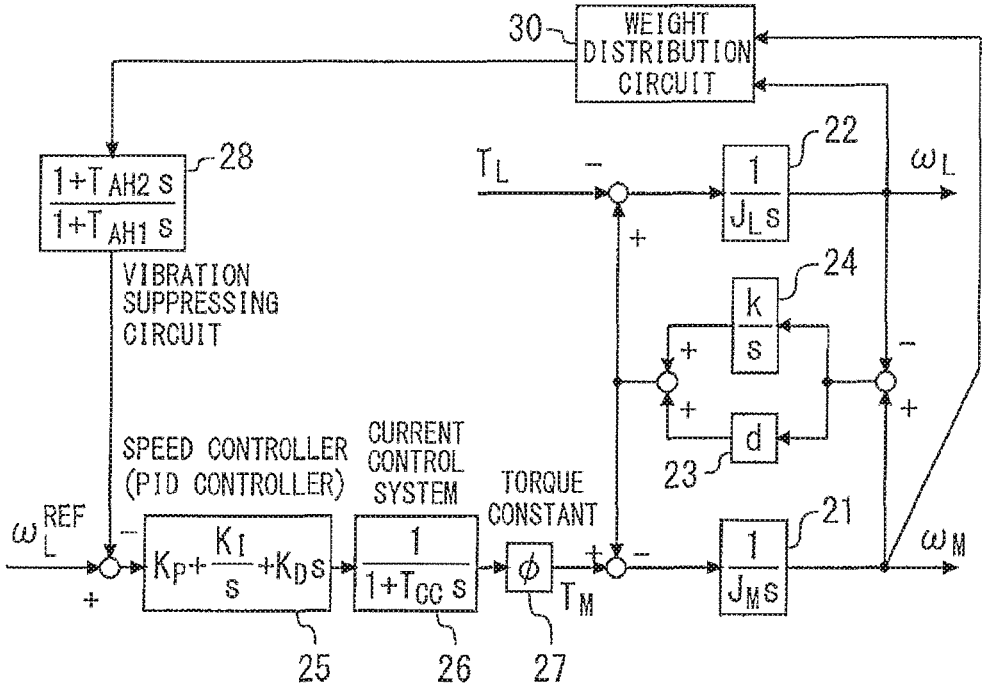
FIG. 8 is a control block diagram showing a control block implemented in the control device 15 in the system related to Embodiment 3 according to the present invention.

FIG. 8 is a control block diagram showing a control block implemented in the control device 15 in the system related to Embodiment 3 according to the present invention. Of the configurations shown in FIG. 8, configurations similar to those of FIG. 6 are provided with same signs, and description thereof will be omitted.

In FIG. 8, as an input to the speed controller 25, an angular speed signal obtained by assigning weights to each of the motor angular speed $\omega_M$ and the load angular speed $\omega_L$, and synthesizing thereof in a weight distribution circuit 30 is used. The weight assignment in the weight distribution circuit 30 is, for example, as follows.

$$\omega_{ML}=\alpha\cdot\omega_M+(1-\alpha)\omega_L \quad (1)$$

Here, $\omega_{ML}$ is an angular speed assigned with weights. $\alpha$ is a weight and generally takes a value between 0 and 1. It is possible to vary $\alpha$ with time.

Use of Expression (1) causes, in general, weight assignment distribution between the load angular speed $\omega_L$ with large variations and the motor angular speed $\omega_M$ with small variations, and accordingly, a signal that suppressed variations of the load angular speed $\omega_L$ is fed back to be used for speed control. For example, in threading in the hot rolling mill, a large torque is applied to the rolling roll and thereby the load angular speed $\omega_L$ becomes vibratory, and if the load angular speed $\omega_L$ is inputted to the speed controller 25 as it is, the control becomes instable in some cases. At this time, a is increased in threading and is reduced with passage of time, and thereby it is possible to facilitate stability in the control system.

REFERENCE SIGNS LIST $\omega_L$ load angular speed (roll rotation shaft angular speed)
$\omega_M$ motor angular speed (motor rotation shaft angular speed)
$\omega_M^{REF}$ target angular speed of the motor 9
$\omega_L^{REF}$ target angular speed of rolling rolls
1, 1*a* rolling mill
2*a* upper work roll
2*b* lower work roll
3*a* upper backup roll
3*b* lower backup roll
4*a*, 4*b* spindle
5 pinion gear
6 shaft
7 motor rotation shaft
8 reduction gear
9, 9*a*, 9*b* motor
10 motor speed sensor
11, 11*a*, 11*b* non-contact type speed sensor
12 material-to-be-rolled
13 perpendicular line
15 control device
16 walls
25, 31 speed controller
26 current control system
28, 32 vibration suppressing circuit
29 selector switch
30 weight distribution circuit
d dumping
$J_L$ inertial moment of the load
$J_M$ inertial moment of the motor
k spring constant
$K_D$ derivative term
$T_{CC}$ time constant
$T_L$ load torque
$T_M$ motor torque

The invention claimed is:

1. A motor speed control device for a rolling mill including a rolling roll configured to roll a metal material, a roll rotation shaft directly connected to the rolling roll, a motor rotation shaft configured to transmit power to the roll rotation shaft, and a motor configured to drive the motor rotation shaft, the motor speed control device for a rolling mill comprising:

a non-contact speed sensor configured to be arranged at a position close to the rolling roll with spacing to a circumferential surface of the roll rotation shaft and to detect a roll rotation shaft angular speed, which is an angular speed of the roll rotation shaft;

a motor speed sensor configured to detect a motor rotation shaft angular speed, which is an angular speed of the motor rotation shaft; and a speed controller configured to control a speed of the motor to a target angular speed of the rolling roll based on a comparison between a synthetic value and the target angular speed of the rolling roll so that the synthetic value coincides with the target angular speed, wherein the synthetic value is a sum of: the motor rotation shaft angular speed multiplied by a ratio, $\alpha$, where $0<\alpha<1$, and the roll rotation shaft angular speed multiplied by a ratio, $(1-\alpha)$.

2. The motor speed control device for a rolling mill according to claim 1, wherein the non-contact speed sensor is arranged on a perpendicular line that crosses a shaft center of the roll rotation shaft and is perpendicular to a surface to be rolled of the metal material, and the roll rotation shaft is movable on the perpendicular line independent of the non-contact speed sensor.

3. The motor speed control device for a rolling mill according to claim 1, further comprising a waterproofing and dust-proofing wall between the non-contact speed sensor and the rolling roll.

4. The motor speed control device for a rolling mill according to claim 1, further comprising:

a switch capable of switching the synthetic value to any of the roll rotation shaft angular speed and the motor rotation shaft angular speed.

5. The motor speed control device for a rolling mill according to claim 1, wherein the ratio $\alpha$ is set larger than the ratio $(1-\alpha)$ when the metal material is threaded in the rolling mill, and is set smaller than the ratio $(1-\alpha)$ as time proceeds.

* * * * *